US011873658B2

(12) United States Patent
Zhang et al.

(10) Patent No.: US 11,873,658 B2
(45) Date of Patent: Jan. 16, 2024

(54) MULTI-ELEVATOR VERTICALLY-LIFTING THREE- DIMENSIONAL PARKING GARAGE

(71) Applicant: Qiqihar Pushi Technology Co., Ltd., Qiqihar (CN)

(72) Inventors: Shipu Zhang, Qiqihar (CN); Linhao Xie, Qiqihar (CN); Yu Liu, Qiqihar (CN); Aijia Zhang, Qiqihar (CN); Shouyi Zhang, Qiqihar (CN)

(73) Assignee: QIQIHAR PUSHI TECHNOLOGY CO., LTD., Qiqihar (CN)

( * ) Notice: Subject to any disclaimer, the term of this patent is extended or adjusted under 35 U.S.C. 154(b) by 239 days.

(21) Appl. No.: 17/597,885

(22) PCT Filed: Feb. 8, 2021

(86) PCT No.: PCT/CN2021/075992
§ 371 (c)(1),
(2) Date: Jan. 28, 2022

(87) PCT Pub. No.: WO2021/212973
PCT Pub. Date: Oct. 28, 2021

(65) Prior Publication Data

US 2022/0170284 A1 Jun. 2, 2022

(30) Foreign Application Priority Data

Apr. 24, 2020 (CN) ..... 202010330696.X

(51) Int. Cl.
*E04H 6/28* (2006.01)
*E04H 6/18* (2006.01)
*E04H 6/42* (2006.01)

(52) U.S. Cl.
CPC ..... *E04H 6/287* (2013.01); *E04H 6/186* (2013.01); *E04H 6/424* (2013.01)

(58) Field of Classification Search
CPC ..... E04H 6/186; E04H 6/287
(Continued)

(56) References Cited

U.S. PATENT DOCUMENTS 4,039,089 A * 8/1977 Kochanneck ..... E04H 6/287 414/256
4,265,581 A * 5/1981 Ives ..... E04H 6/287 414/254

(Continued)

FOREIGN PATENT DOCUMENTS

CN 102333927 A 1/2012
CN 106013898 A 10/2016

(Continued)

OTHER PUBLICATIONS

CN 106013898 A (Qinhuangdao Xi'an Heavy Machinery) Oct. 12, 2016 (English language machine translation). [online] [retrieved Nov. 13, 2023]. Retrieved from: espacenet. (Year: 2016).*

*Primary Examiner* — Jonathan Snelting
(74) *Attorney, Agent, or Firm* — Bayramoglu Law Offices LLC

(57) ABSTRACT

A multi-elevator vertically-lifting three-dimensional parking garage is disclosed. The parking garage includes a base, an elevator guide rail group, elevator guide rail seats, first guide rails, second guide rails, clamping mechanisms, annular parking spaces, and vehicle body adjustment devices; the elevator guide rail group is disposed on the base, the base is in shafting connection with the elevator guide rail group, the multiple elevator guide rail seats capable of sliding up and down are disposed on the elevator guide rail group, the elevator guide rail seats are hingedly connected to the first guide rails, the first guide rails are hingedly connected to the second guide rails in a sliding manner, the second guide rails are connected to the clamping mechanisms in a sliding (Continued)

manner, the annular parking spaces are disposed on the periphery of the elevator guide rail group in a surrounding manner.

10 Claims, 15 Drawing Sheets

(58) Field of Classification Search
USPC ..... 414/254
See application file for complete search history.

(56) References Cited

U.S. PATENT DOCUMENTS 4,976,580 A * 12/1990 Knakrick ..... E04H 6/287 414/256
6,212,832 B1 * 4/2001 Gao ..... E04H 6/285 52/174

FOREIGN PATENT DOCUMENTS

| | | | |
|---|---|---|---|
| CN | 106150164 | A | 11/2016 |
| CN | 108999447 | A | 12/2018 |
| CN | 111411806 | A | 7/2020 |
| DE | 4444257 | A1 | 6/1996 |

* cited by examiner

MULTI-ELEVATOR VERTICALLY-LIFTING THREE- DIMENSIONAL PARKING GARAGE

CROSS REFERENCE TO THE RELATED APPLICATIONS

This application is the national phase entry of International Application No. PCT/CN2021/075992, filed on Feb. 8, 2021, which is based upon and claims priority to Chinese Patent Application No. 202010330696.X, filed on Apr. 24, 2020, the entire contents of which are incorporated herein by reference.

TECHNICAL FIELD

The present invention relates to a multi-elevator vertically-lifting three-dimensional parking garage, belonging to the technical field of parking garages.

BACKGROUND

As the development direction of the parking garage in the future, three-dimensional parking garage has a bright future with less occupied area, low relative cost, convenient Internet management, and vertical lifting three-dimensional parking garage is a representative. Therefore, the demand for a multi-elevator vertically-lifting three-dimensional parking garage is increasing day by day.

When the existing devices are in use, the vertical lifting parking garage has some shortcomings more or less, which is comprehensively manifested in the contradiction between the efficiency of parking and picking up vehicles and the storage capacity, that is, it is easy to increase the storage capacity, but it is not easy to improve the speed of parking and picking up vehicles. At the same time, the vehicle lifting mode of the existing device has a narrow application range and poor fixing effect, which cannot be applied to lifting of various vehicles and is relatively single. Therefore, a multi-elevator vertically-lifting three-dimensional parking garage is put forward in view of the above problems.

SUMMARY

In order to solve the shortcomings of the prior art, the present invention provides a multi-elevator vertically-lifting three-dimensional parking garage, which reduces the parking garage space and improves the efficiency of parking and picking up of vehicles by means of coordinated operation of multiple elevators.

The technical solution adopted by the present invention to solve its technical problems is: a multi-elevator vertically-lifting three-dimensional parking garage including a base, an elevator guide rail group, elevator guide rail seats, first guide rails, second guide rails, clamping mechanisms, annular parking spaces, and vehicle body adjustment devices; the elevator guide rail group is disposed on the base, the base is in a shafting connection with the elevator guide rail group, the elevator guide rail seats configured for sliding up and down are disposed on the elevator guide rail group, the elevator guide rail seats are hingedly connected to the first guide rails, the first guide rails are hingedly connected to the second guide rails in a sliding manner, the second guide rails are connected to the clamping mechanisms in a sliding manner, the annular parking spaces are disposed on a periphery of the base and the elevator guide rail group in a surrounding manner, an upper end of the elevator guide rail group is in the shafting connection with a top of the annular parking spaces, and each parking space at an access floor of the annular parking spaces is provided with the vehicle body adjustment device.

A lower end of the elevator guide rail group is provided with a turbine disk, an upper end of the turbine disk is provided with a disk, a lower end of the turbine disk is a turbine disk convex shaft, an upper end of the disk is a disk convex shaft, three rails are uniformly fixed and connected between the turbine disk and the disk, an upper portion of each of the three rails is provided with a bypass wheel, a first sprocket wheel is disposed below the bypass wheel, a lower portion of each of the three rails is provided with a second sprocket wheel, the first sprocket wheel is connected with a motor, an inside surface of each of the three rails is provided with a counterweight, the counterweight slides up and down on the inside surface of each of the three rails, an outside surface of each of the three rails is provided with the elevator guide rail seat, and the elevator guide rail seat slides up and down on the outside surface of each of the three rails, the counterweight is connected to the elevator guide rail seat through a traction rope bypassing the bypass wheels, and two ends of a first chain bypass the first sprocket wheel and the second sprocket wheel to be connected to the elevator guide rail seat. The turbine disk convex shaft is connected with a first bearing.

The first bearing is disposed at a center of the base, the base is provided with a horizontal motor connected with a worm, the turbine disk convex shaft is connected with the first bearing, and a turbine disk is connected with the worm.

The elevator guide rail seat is provided with a first bidirectional hydraulic cylinder on a side of the elevator guide rail seat, and the first bidirectional hydraulic cylinder is hingedly connected to the elevator guide rail seat and the first guide rail; and a first screw is disposed in the first guide rail, a first motor is disposed at one end away from the elevator guide rail seat, an output shaft of the first motor is connected with the first screw in the first guide rail through a first coupling, a first slider is disposed on the first guide rail, and the first slider is connected with the first screw through first balls.

The first slider is provided with a second pressure bearing, the second pressure bearing is provided with a rotation shaft, an upper end of the rotation shaft is connected with a third sprocket wheel, the third sprocket wheel is axially fixed with the rotation shaft through a nut on the rotation shaft, the third sprocket wheel is connected with a motor and third sprocket wheel combination, the motor and third sprocket wheel combination is fixedly installed on the first slider, and a lower end of the rotation shaft is fixedly connected with a second slider; and the second slider slides in the second guide rail, a second motor is disposed at a rear position of the second guide rail, an output shaft of the second motor is connected with a second screw in the second guide rail through a second coupling, and the second screw is connected with the second slider through second balls.

The second guide rail is I-shaped and composed of upper and lower rails, and the lower rails are wider than the upper rails; the clamping mechanisms are disposed below the second guide rails, and the clamping mechanism is configured to slide in the second guide rails; the clamping mechanism includes a supporting frame, a lifting slider, a front roller station and a rear roller station; fourth screws are respectively disposed at the two sides of the supporting frame, and a fourth motor is connected with the fourth screws; lifting sliders are symmetrically disposed on the two sides of the supporting frame, the lifting sliders are connected with the fourth screws through fourth balls, the supporting frame is connected with a third screw through third balls, the third screw is disposed on the second guide rail, and the horizontal third screw is connected with a third motor through the coupling; and two ends of each of the lifting sliders are respectively provided with the front roller station and the rear roller station.

The front roller station consists of a front first roller and a front second roller, and the front first roller is fixedly connected with the lifting slider; the front second roller is connected with a fifth screw, the fifth screw is connected with a fifth motor fixed on the front first roller, and the front second roller is connected with the front first roller in a sliding manner; and the rear roller station consists of a rear first roller and a rear second roller, the front first roller is connected with the front second roller in a sliding manner, the rear second roller is connected with a sixth screw, the sixth screw is connected with a sixth motor fixed on the rear first roller, the rear first roller is connected with a seventh screw, the seventh screw is connected with a seventh motor fixed on the lifting slider, the rear first roller is connected with the lifting slider in a sliding manner, the front first roller, the front second roller, the first roller station and the rear second roller are respectively connected with the motor, and are controlled to open or close by the motor.

Two ends of lower ends of opposite inner sides of two lifting sliders are respectively provided with safety protection rods, the safety protection rods are in the shafting connection with the lifting slider, connected with the motor, and controlled to open or close by the motor, a level of each of the safety protection rod is higher than levels of the front roller station and the rear roller station.

The annular parking space is divided into an access floor with entrances and exits and a basic floor with only parking spaces, the parking spaces on each of the basic floors are aligned up and down, a top of each parking space in the annular parking space is provided with a hanging auxiliary slideway, the hanging auxiliary slideway is mated with the second guide rail, an upper end of the annular parking space is provided with a cross beam, the cross beam is fixedly connected with the annular parking space, a shaft hole is disposed in a center of the cross beam, and a disk convex shaft is connected in the shaft hole, and each parking space on the access floor of the annular parking space is provided with the vehicle body adjustment device.

The vehicle body adjustment device consists of a roller part and an adjustment mechanism, wherein the roller part consists of two pairs of roller groups and two pairs of concave wheel groups longitudinally disposed on a bottom plate; the adjustment mechanism consists of two long push rods, an articulated link, a parallel articulated four-link, a second bidirectional hydraulic cylinder, a stationary shaft, a third sprocket wheel and an electromagnetic clutch; the articulated link and the parallel articulated four-link are respectively hingedly connected to the two long push rods, a plane position of each of the two long push rods is higher than a height of a plane where the two pairs of roller groups and the two pairs of concave wheel groups are located, each roller of the two pairs roller groups and the two pairs of concave wheel groups is connected with the third sprocket wheel, the third sprocket wheels on the two pairs of roller groups and the two pairs of concave wheel groups are connected by a second chain and connected to the electromagnetic clutch, the articulated link and the parallel articulated four-link are respectively hinged with bottom plates on both sides, the articulated link is fixed on the bottom plate through the stationary shaft, a first end of the parallel articulated four-link is fixed on the bottom plate through the stationary shaft, a second end of the parallel articulated four-link is hinged with a first end of the second bidirectional hydraulic cylinder, and a second end of the second bidirectional hydraulic cylinder is fixed on the bottom plate by the stationary shaft.

All moving parts are run under a control of a parking garage central computer; the parking garage central computer includes: a vehicle information collection system, a vehicle measurement system, a parking space allocation system, a motion management system, a monitoring system and a parking fee collection system; and a computer control system is capable of transmitting data with a wisdom platform.

An initial position of the clamping mechanism is that the clamping mechanism is located directly below a center of second guide rail, a direction of the second guide rail is perpendicular to first guide rail, the second guide rail is centered on a side of the first guide rail close to the elevator guide rail seat, an initial state of clamping mechanism is that the lifting slider is at a specific high position of the supporting frame, all of the roller stations are in a closed state, four safety protection rods are respectively attached to the lifting sliders, when a vehicle enters the parking space at the entrance and exit, the vehicle drives onto the adjustment device, and when front wheels of the vehicle enter the adjustment concave wheel group, it is indicated that the vehicle is basically in place due to a height drop, and then the second bidirectional hydraulic cylinder is driven to make the two long push rods move synchronously to both sides, so that the left and right wheels of the vehicle fit the two long push rods respectively, a center of the vehicle body matches a center of the parking space, and the vehicle body is aligned.

When parking or picking up the vehicle, the motor is driven to work to make the elevator guide rail seat to a specified height, the a first bidirectional hydraulic cylinder or the horizontal motor is driven to rotate the elevator guide rail group, the first guide rail can be adjusted to a designated parking space direction, corresponding to the vehicle whose body has been adjusted or the vehicle to be taken away, the second guide rail slides along the first guide rail to turn, at the same time, the clamping mechanism is driven to move in an opposite direction to the second guide rail, and the clamping mechanism is kept below the first guide rail as much as possible, when the second guide rail enters the hanging auxiliary slideway, the clamping mechanism moves in a direction of the hanging auxiliary slideway, when a sensor of the front roller station of the clamping mechanism detects front wheels of the vehicle, the front second roller is turned to a 90 degree position, the rear first roller is turned to the 90 degree position, when the clamping mechanism continues to move until the front second roller comes into contact with the front wheels of the vehicle, the front first roller turns to the 90 degree position, and the supporting frame stops moving; at this time, the rear first roller continues to move under a drive of the sixth motor until the first roller comes into contact with the rear wheels of the vehicle and stops; at this time, the rear second roller is turned to the 90 degree position, so that each roller is finely adjusted to be in close contact with the corresponding wheels, and the four safety protection rods are respectively turned to the 90 degree position; The lifting slider is driven to rise to lift the vehicle up, the supporting frame is driven to move reversely and suspend below the hanging auxiliary rail, when the second guide rail moves back to a certain position, the supporting frame continues to move, the second guide rail is close to one side of elevator guide rail seat, the second guide rail is driven to move and rotate in reverse to restore the clamping mechanism to the initial position, then the elevator guide rail seat is driven to a designated parking space floor, the second guide rail, the supporting frame and the lifting slider are driven, the first bidirectional hydraulic cylinder or the horizontal motor is driven to rotate the elevator guide rail group, so that the first guide rail can be adjusted to a designated parking space direction, and the vehicle body can be placed in the designated parking space or the parking space at the entrance and exit.

When parking the vehicle, a driver drives the vehicle onto the vehicle body adjustment device, then the driver gets off, a computer recognizes the number plate of the vehicle, the driver can print the voucher, or the computer uploads the information to the driver's mobile phone through the Internet, the vehicle body adjustment device adjusts the vehicle body, and the clamping mechanism puts the vehicle body in the designated parking space to complete the parking.

When picking up the vehicle, the driver uploads the vehicle picking up information to the computer through the voucher or the Internet, the clamping mechanism puts the vehicle in the parking space at the entrance and exit, and the computer confirms that the driver has paid the parking fee, and raises the brake lever to complete picking up the vehicle.

The beneficial effects of the present invention are: 1. in the present invention, by providing the adjustment device, it is possible in present invention to fix and adjust vehicle bodies with different heights and different parking angles, the lifting slider, the front roller station and the rear roller station are used together, so that it is possible in the present invention to adjust positions of the front roller station and the rear roller station according to the positions of the wheels of the vehicle body to ensure the fixing quality and fixing firmness, and the coordination between the front roller station and the rear roller station enables the device to fix wheels of different sizes, which increases the fixing range of the device and the fixing firmness of the device;

2. in the present invention, by disposing three groups of clamping mechanism to operate cooperatively and independently, an access efficiency of parking garage is improved, and the contradiction between the efficiency of parking and picking up vehicles and the number of parking spaces is solved; increasing the number of elevators increases the speed of parking and picking up vehicles, allows for more parking spaces in the parking garage and reduces overall costs. The folding of the clamping mechanisms reduces the operating space and greatly reduces the construction cost; and 3. the computer control system and the wisdom platform transmit data to each other, and manage the wisdom city platform on the basis of automatic operation, which is convenient for people to parking and pick up vehicles and more intelligent.

BRIEF DESCRIPTION OF THE DRAWINGS

The present invention is further described below in conjunction with the accompanying drawings and detailed description.

REFERENCE SIGNS IN THE DRAWINGS

Figure 1:
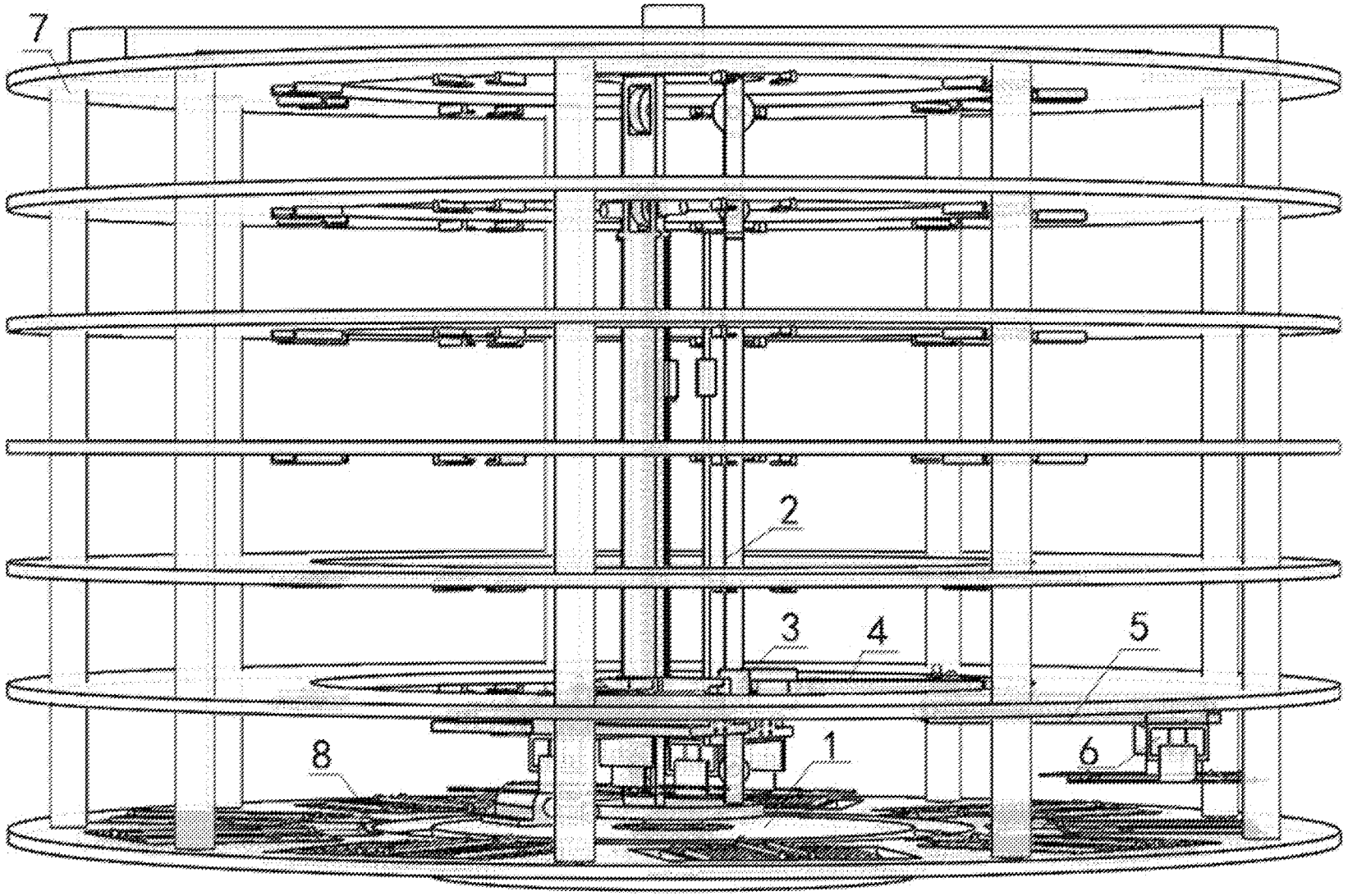
FIG. 1 is a wide-angle view of the present invention.
Figure 2:
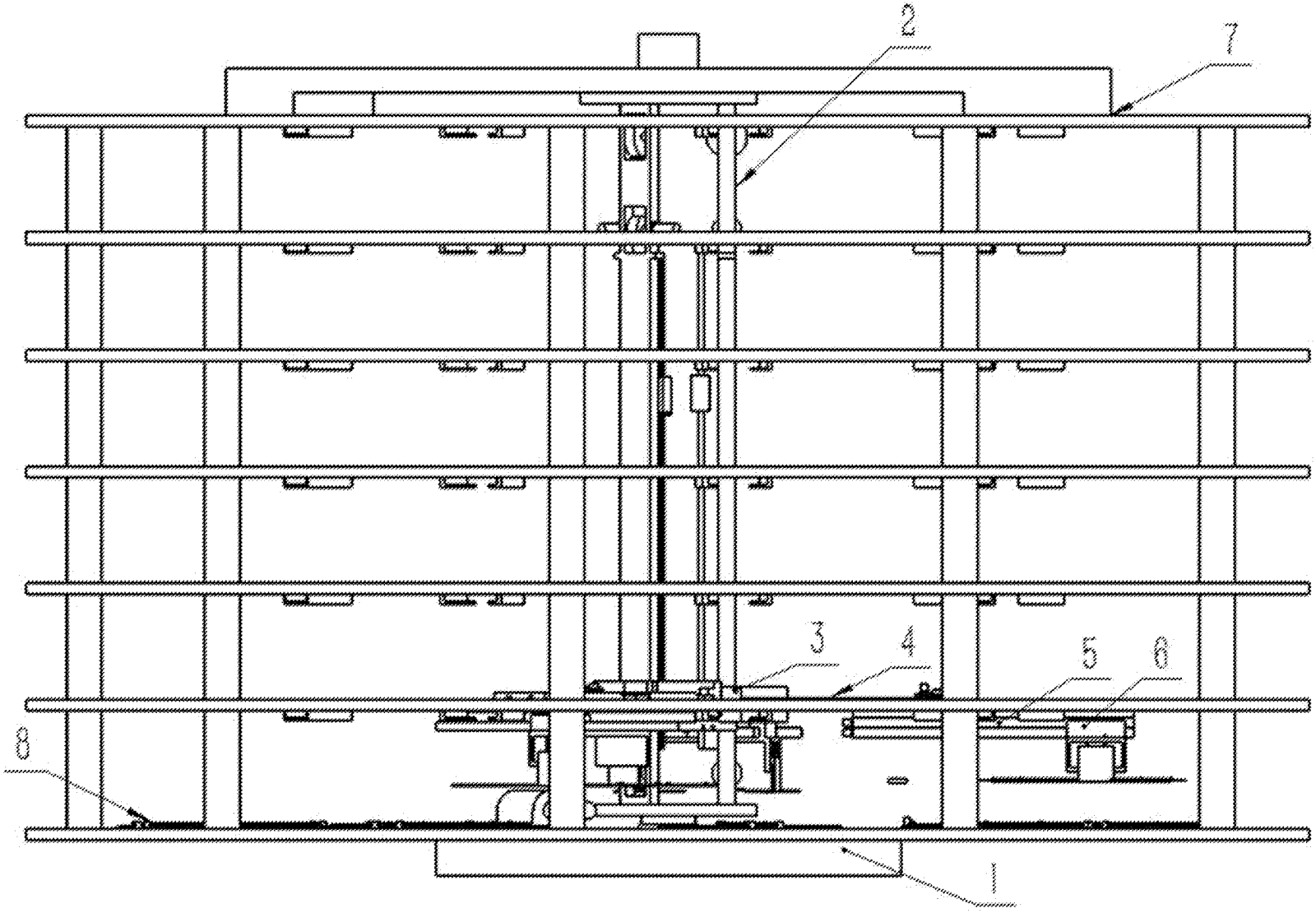
FIG. 2 is a front view of the present invention.
Figure 3:
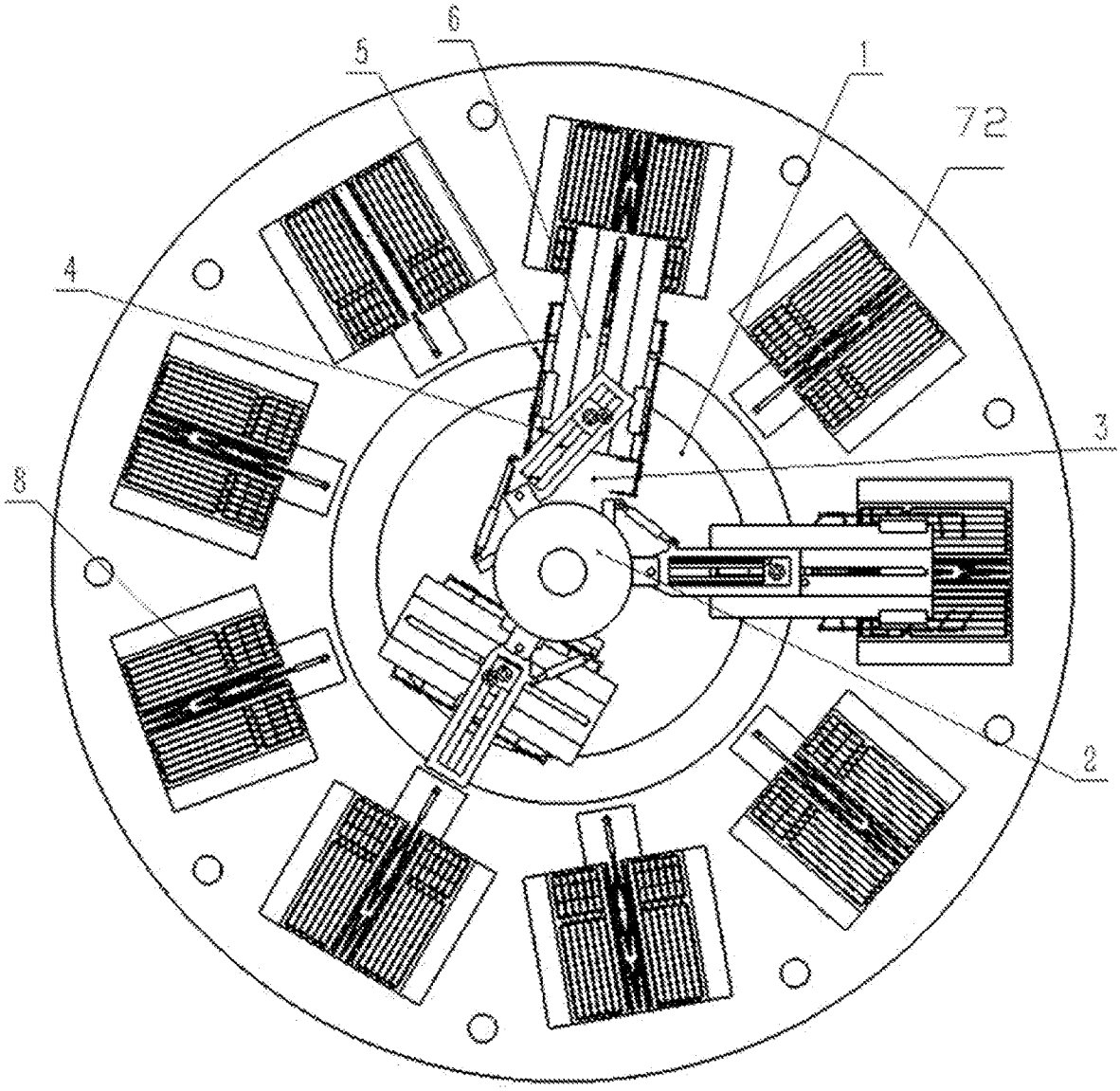
FIG. 3 is a top view of accessing a garage.
Figure 4:
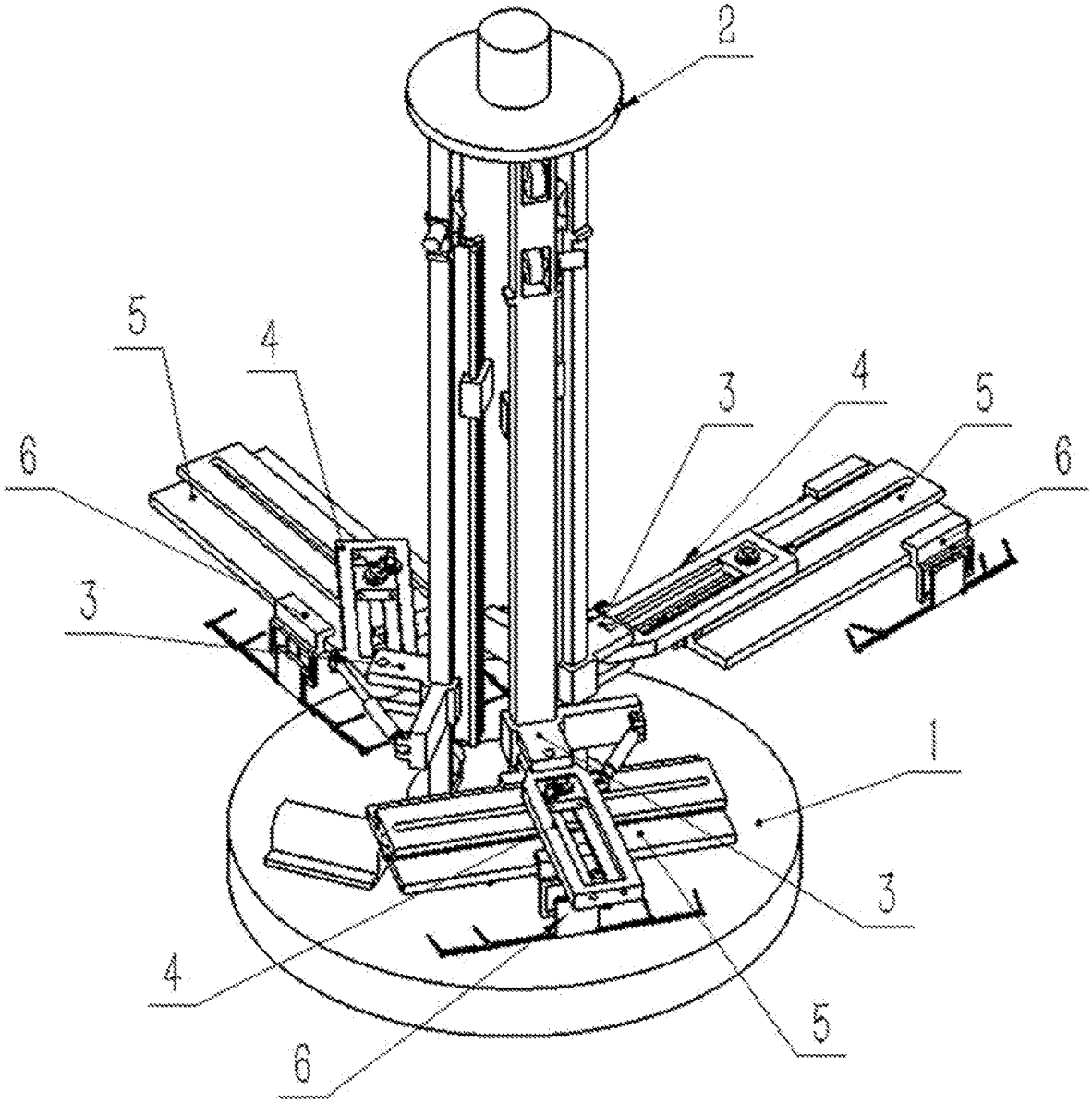
FIG. 4 is a schematic diagram of an internal structure of the present invention.
Figure 5:
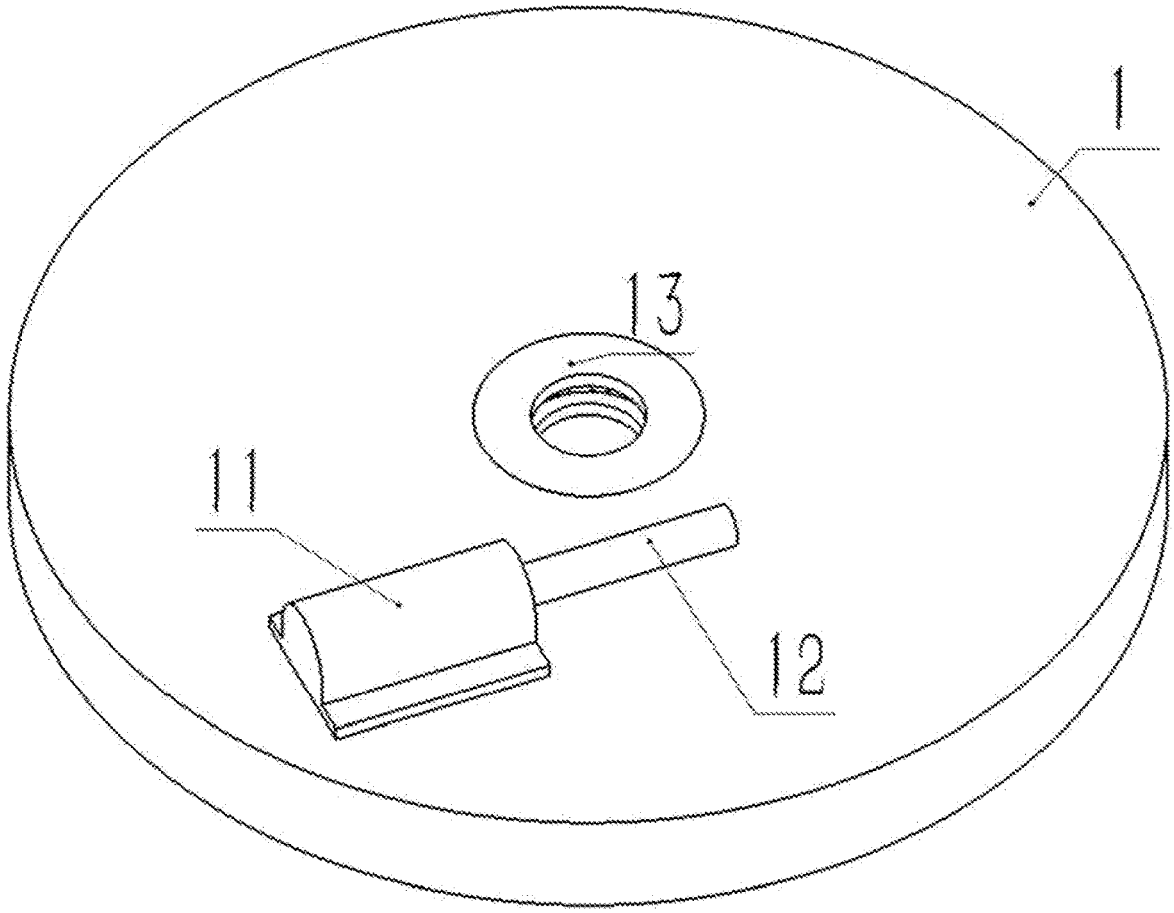
FIG. 5 is a schematic structural diagram of a base.
Figure 6:
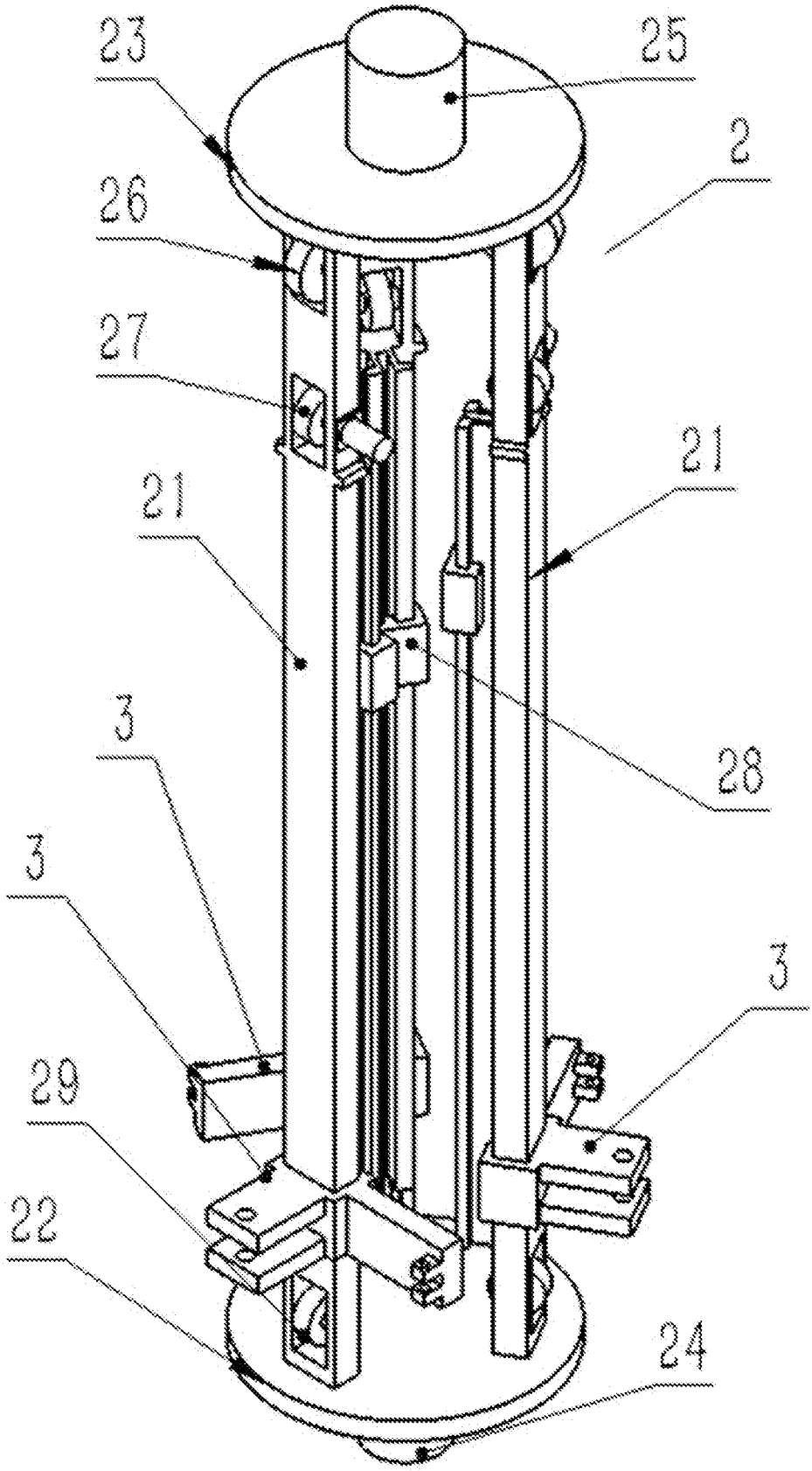
FIG. 6 is a structural schematic diagram of an elevator guide rail.

1. base, 11. horizontal motor, 12. worm, 13. first pressure bearing, 2. elevator guide rail group, 21. rail, 22. turbine disk, 23. disk, 24. turbine disk convex shaft, 25. disk convex shaft, 26. bypass wheel, 27. first sprocket wheel, 28. counterweight, 29. second sprocket wheel, 3. elevator guide rail seat, 31. first bidirectional hydraulic cylinder, 4. first guide rail, 41. first slider, 42. third sprocket wheel, 43. motor and third sprocket wheel combination, 44. second pressure bearing, 45. nut, 5. second guide rail, 51, second slider, 52. rotation shaft, 6, clamping mechanism, 61, supporting frame, 62, lifting slider, 63, rear first roller, 64, rear second roller, 65, front first roller, 66, front second roller, 67, safety protection rod, 7, annular parking space, 71, hanging auxiliary slideway, 72, floor of accessing garage, 8, vehicle body adjustment device, 81, roller group, 82, concave wheel group, 83, long push rod, 84, articulated link, 85, parallel articulated four-link, 86, second bidirectional hydraulic cylinder, 87, stationary shaft, 88, third sprocket wheel, 89, electromagnetic clutch, 9, vehicle.

DETAILED DESCRIPTION OF THE EMBODIMENTS

As shown in FIGS. 1-13, a multi-elevator vertically-lifting three-dimensional parking garage including a base 1, an elevator guide rail group 2, elevator guide rail seats 3, first guide rails 4, second guide rails 5, clamping mechanisms 6, annular parking spaces 7 and vehicle body adjustment devices 8; and the elevator guide rail group 2 is disposed on the base 1, the base 1 is in a shafting connection with the elevator guide rail group 2, the elevator guide rail seats 3 configured for sliding up and down are disposed on the elevator guide rail group 2, the elevator guide rail seats 3 are hingedly connected to the first guide rails 4, the first guide rails 4 are hingedly connected to the second guide rails 5 in a sliding manner, the second guide rails 5 are connected to the clamping mechanisms 6 in a sliding manner, the annular parking spaces 7 are disposed on a periphery of the elevator guide rail group 2 in a surrounding manner, an upper end of the elevator guide rail group 2 is in the shafting connection with a top of the annular parking spaces 7, and each parking space at entrance and exit layers of the annular parking spaces 7 is provided with the vehicle body adjustment device 8.

A lower end of the elevator guide rail group 2 is provided with a turbine disk 22, an upper end of the turbine disk is provided with a disk 23, a lower end of the turbine disk 22 is a turbine disk convex shaft 24, an upper end of the disk 23 is a disk convex shaft 25, three rails 21 are fixedly connected between the turbine disk 22 and the disk 23, an upper portion of each of the three rails 21 is provided with a bypass wheel 26, a first sprocket wheel 27 is disposed below the bypass wheel 26, a lower portion of each of the three rails 21 is provided with a second sprocket wheel 29, the first sprocket wheel 27 is connected with a motor, an inside surface of each of the three rails 21 is provided with a counterweight 28, the counterweight 28 slides up and down on the inside surface of each of the three rails 21, an outside surface of each of the three rails 21 is provided with the elevator guide rail seat 3, and the elevator guide rail seat 3 slides up and down on the outside surface of each of the three rails 21, the counterweight 28 is connected to the elevator guide rail seat 3 through a traction rope bypassing the bypass wheel 26, and two ends of a first chain bypass the first sprocket wheel 27 and the second sprocket wheel 29 to be connected to the elevator guide rail seat 3.

A first bearing 13 is disposed at a center of the base 1, the base 1 is provided with a horizontal motor 11 connected with a worm 12, the turbine disk convex shaft 24 is connected with the first bearing 13, and the turbine disk 22 is connected with the worm 12.

The elevator guide rail seat 3 is provided with a first bidirectional hydraulic cylinder 31 on a side of the elevator guide rail seat, and the first bidirectional hydraulic cylinder 31 is hingedly connected to the elevator guide rail seat 3 and the first guide rail 4; and a first screw is disposed in the first guide rail 4, a first motor is disposed at one end away from the elevator guide rail seat 3, an output shaft of the first motor is connected with the first screw in the first guide rail 4 through a first coupling, a first slider 41 is disposed on the first guide rail 4, and the first slider 41 is connected with the first screw through first balls.

The first slider 41 is provided with a second pressure bearing 44, the second pressure bearing 44 is provided with a rotation shaft 52, an upper end of the rotation shaft 52 is connected with a third sprocket wheel 42, the third sprocket wheel 42 is axially fixed with the rotation shaft 52 through a nut 45 on the rotation shaft 52, the third sprocket wheel 42 is connected with a motor and third sprocket wheel combination 43, the motor and third sprocket wheel combination 43 is fixedly installed on the first slider 41, and a lower end of the rotation shaft 52 is fixedly connected with a second slider 51; and the second slider 51 slides in the second guide rail 5, a second motor is disposed at a rear position of the second guide rail 5, an output shaft of the second motor is connected with a second screw in the second guide rail 5 through a first coupling, and the second screw is connected with the second slider 51 through second balls.

The second guide rail 5 is I-shaped and composed of upper and lower rails, and the lower rails are wider than the upper rails; the clamping mechanism 6 is disposed below the second guide rail 5, and the clamping mechanism 6 is configured to slide in second guide rail 5; the clamping mechanism 6 includes a supporting frame 61, a lifting slider 62, a front roller station and a rear roller station; fourth screws are respectively disposed at the two sides of the supporting frame 61, and a fourth motor is connected with the fourth screws; lifting sliders 62 are symmetrically disposed on the two sides of the supporting frame 61, the lifting sliders 62 are connected with the fourth screws through fourth balls, the supporting frame 61 is connected with a horizontal third screw through third balls, the horizontal third screw is disposed on the second guide rail 5, and the third screw is connected with the third motor through the coupling; and two ends of each of the lifting sliders 62 are symmetrically provided with the front roller station and the rear roller station, respectively.

The front roller station consists of a front first roller 65 and a front second roller 66, and the front first roller 65 is fixedly connected with the lifting slider 62; the front second roller 66 is connected with a fifth screw, the fifth screw is connected with a fifth motor fixed on the front first roller 65, and the front second roller 66 is connected with the front first roller 65 in a sliding manner; and the rear roller station consists of a rear first roller 63 and a rear second roller 64, the front first roller 65 is connected with the front second roller 66 in a sliding manner, the rear second roller 64 is connected with a sixth screw, the sixth screw is connected with a sixth motor fixed on the rear first roller 63, the rear first roller 63 is connected with a seventh screw, the seventh screw is connected with a seventh motor fixed on the lifting slider 62, the rear first roller 63 is connected with the lifting slider 62 in a sliding manner, the front first roller 65, the front second roller 66, the first roller station 63 and the rear second roller 64 are respectively connected with the motor, and are controlled to open or close by the motor.

Two ends of lower ends of opposite inner sides of two lifting sliders 62 are respectively provided with safety protection rods 67, the safety protection rods 67 are in the shafting connection with the two lifting sliders 62, connected with the motor 67, and controlled to open or close by the motor, a level of each of the safety protection rod 67 is higher than levels of the front roller station and the rear roller station.

The annular parking space 7 is divided into an access floor with entrances and exits and a basic floor with only parking spaces, the parking spaces on each of the basic floors are aligned up and down, a top of each layer of the annular parking space 7 is provided with a hanging auxiliary slideway 71, the hanging auxiliary slideway 71 is mated with the second guide rail 5, an upper end of the annular parking space 7 is provided with a cross beam, the cross beam is fixedly connected with the annular parking space 7, a shaft hole is disposed in a center of the cross beam, and a disk convex shaft 25 is connected in the shaft hole, and each parking space on the access floor of the annular parking space 7 is provided with the vehicle body adjustment device 8.

The vehicle body adjustment device 8 consists of a roller part and an adjustment mechanism, wherein the roller part consists of two pairs of roller groups 81 and two pairs of concave wheel groups 82 longitudinally disposed on a bottom plate; the adjustment mechanism consists of two long push rods 83, an articulated link 84, a parallel articulated four-link 85, a second bidirectional hydraulic cylinder 86, a stationary shaft 87, a third sprocket wheel 88 and an electromagnetic clutch 89; the articulated link 84 and the parallel articulated four-link 85 are respectively hingedly connected to the two long push rods 83, a plane position of each of the two long push rods 83 is higher than a height of a plane where the two pairs of roller groups 81 and the two pairs of concave wheel groups 82 are located, each roller of the two pairs of roller groups 81 and the two pairs of concave wheel groups 82 is connected with the third sprocket wheel 88, the third sprocket wheels 88 on the two pairs of roller groups 81 and the two pairs of concave wheel groups 82 is connected by a second chain and connected to the electromagnetic clutch 89, the articulated link 84 is fixed on the bottom plate through the stationary shaft 87, a first end of the parallel articulated four-link 85 is fixed on the bottom plate through the stationary shaft 87, a second end of the parallel articulated four-link 85 is hinged with a first end of the second bidirectional hydraulic cylinder 86, and a second end of the second bidirectional hydraulic cylinder 86 is fixed on the bottom plate by the stationary shaft 87.

All moving parts are run under a control of a parking garage central computer; the parking garage central computer includes: a vehicle information collection system, a vehicle measurement system, a parking space allocation system, a motion management system, a monitoring system and a parking fee collection system; and a computer control system is capable of transmitting data with a wisdom platform.

Figure 7:
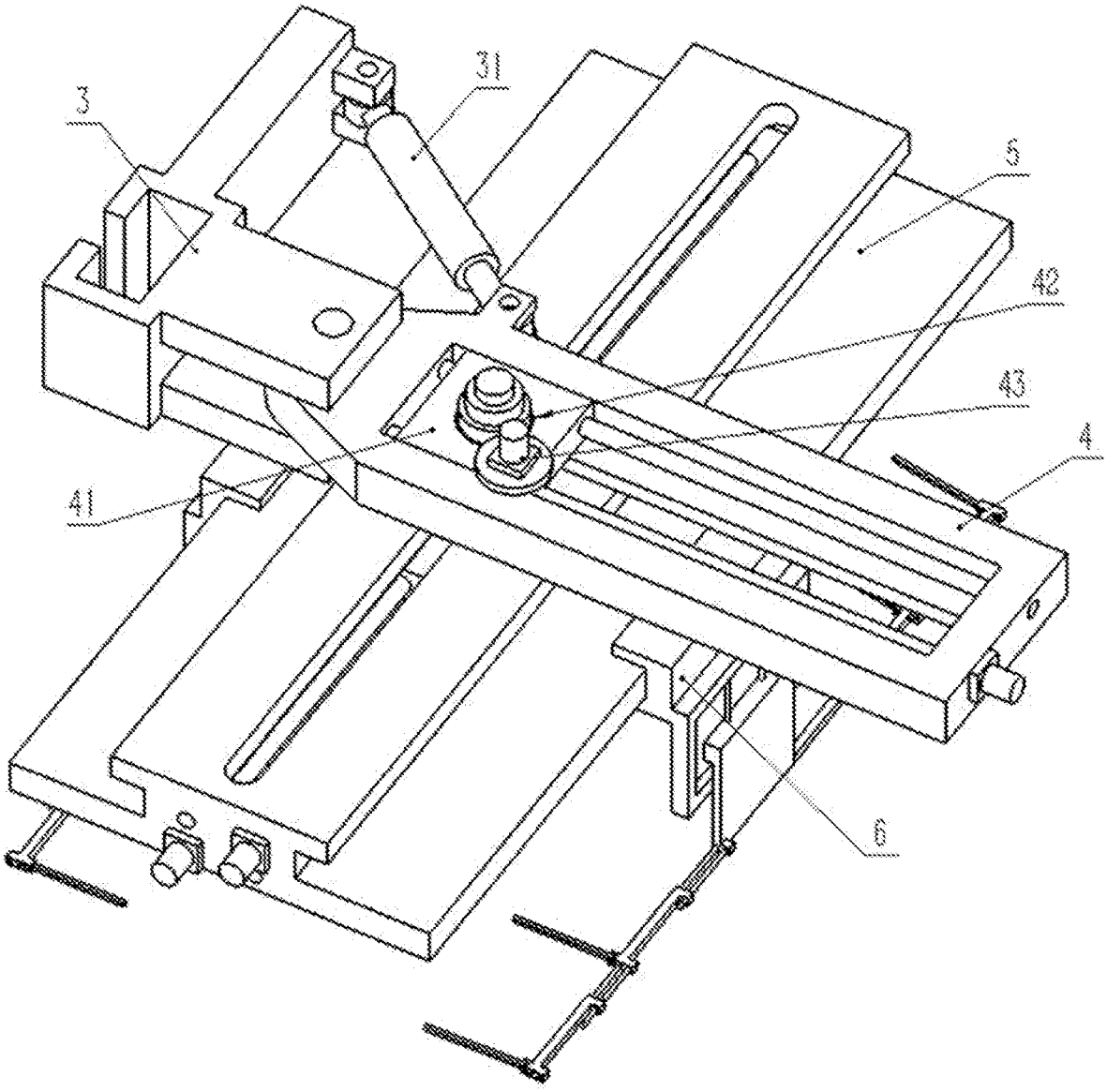
FIG. 7 is a schematic diagram of initial states of a first guide rail and a second guide rail.
Figure 8:
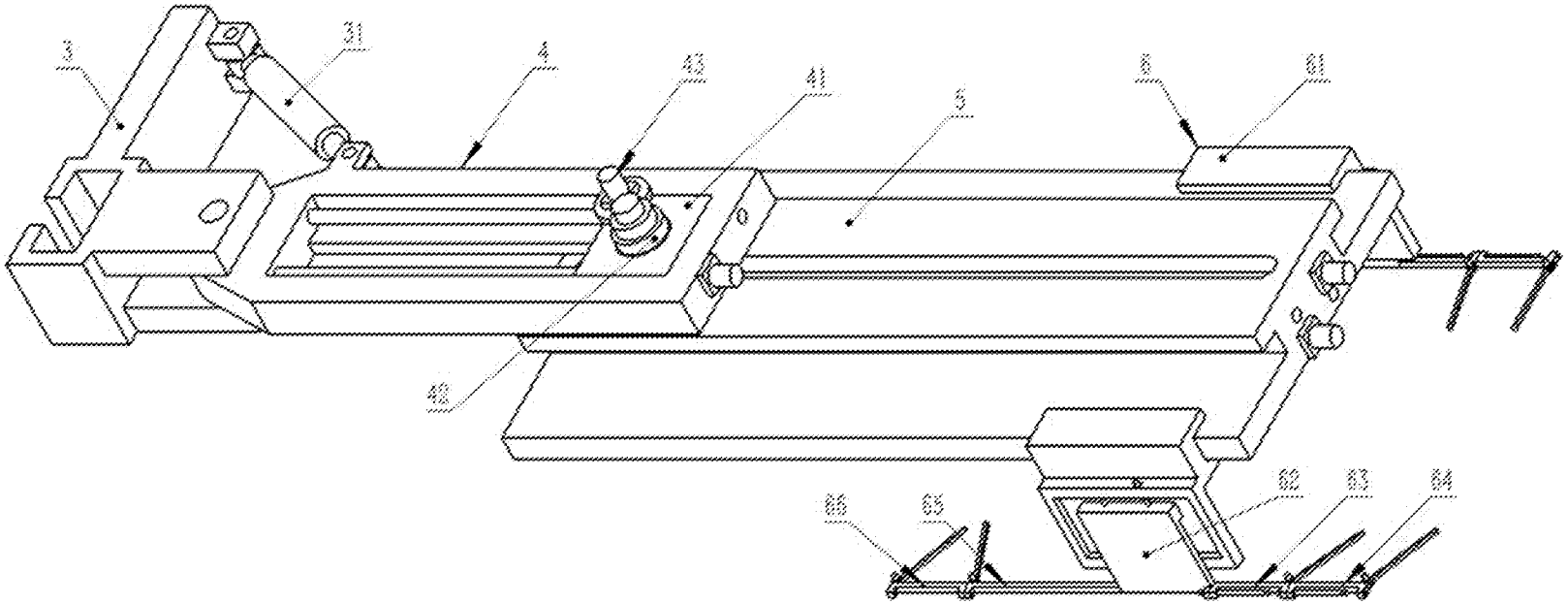
FIG. 8 is a schematic diagram of the first guide rail and the second guide rail in a vehicle supporting state.
Figure 9:
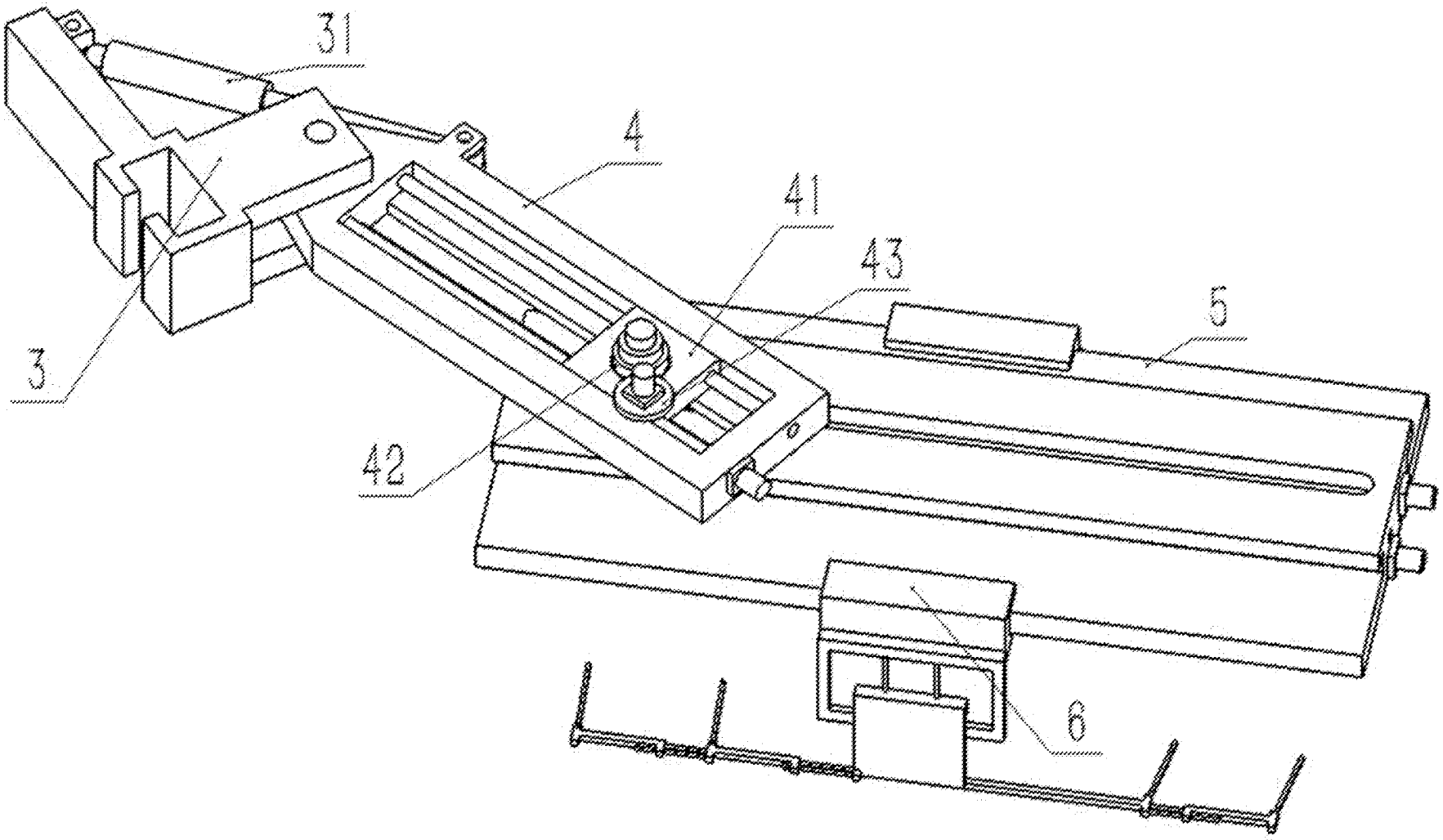
FIG. 9 is a schematic diagram of the first guide rail and second guide rail in a vehicle parking state.
Figure 10:
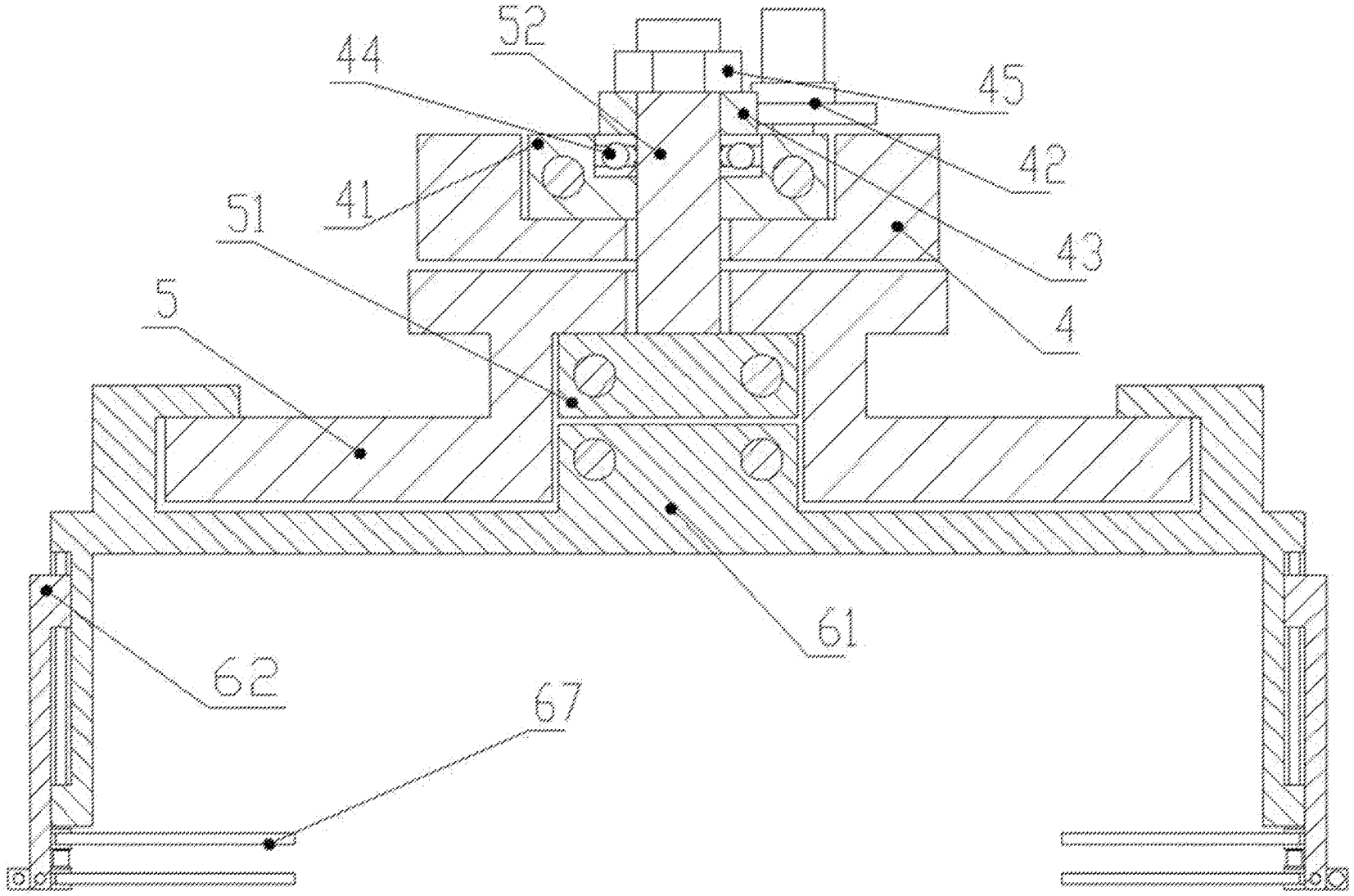
FIG. 10 is a schematic structural diagram of connection between first guide rail and second guide rail in vehicle parking.
Figure 11:
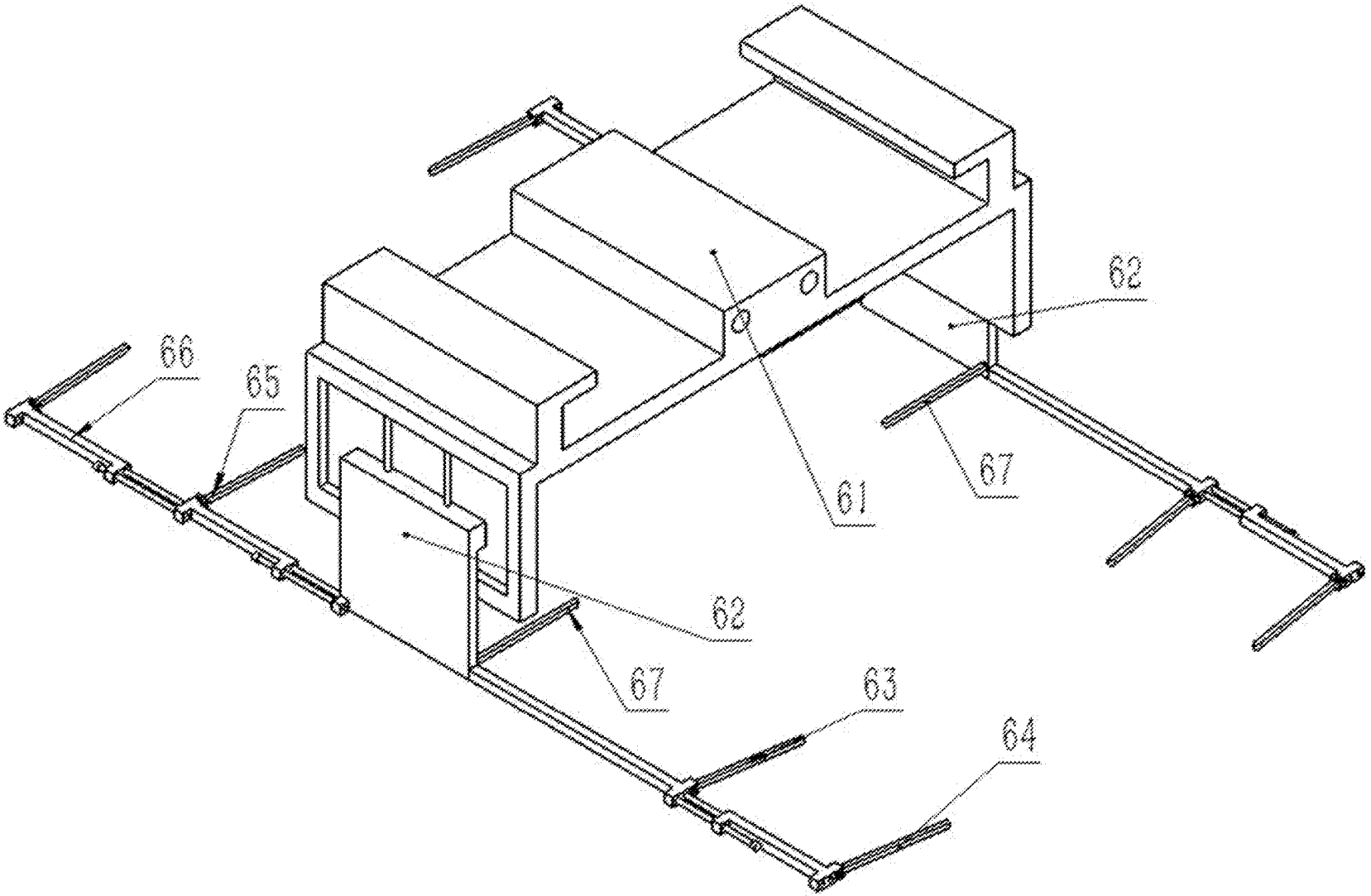
FIG. 11 is a schematic structural diagram of a clamping mechanism.
Figure 12:
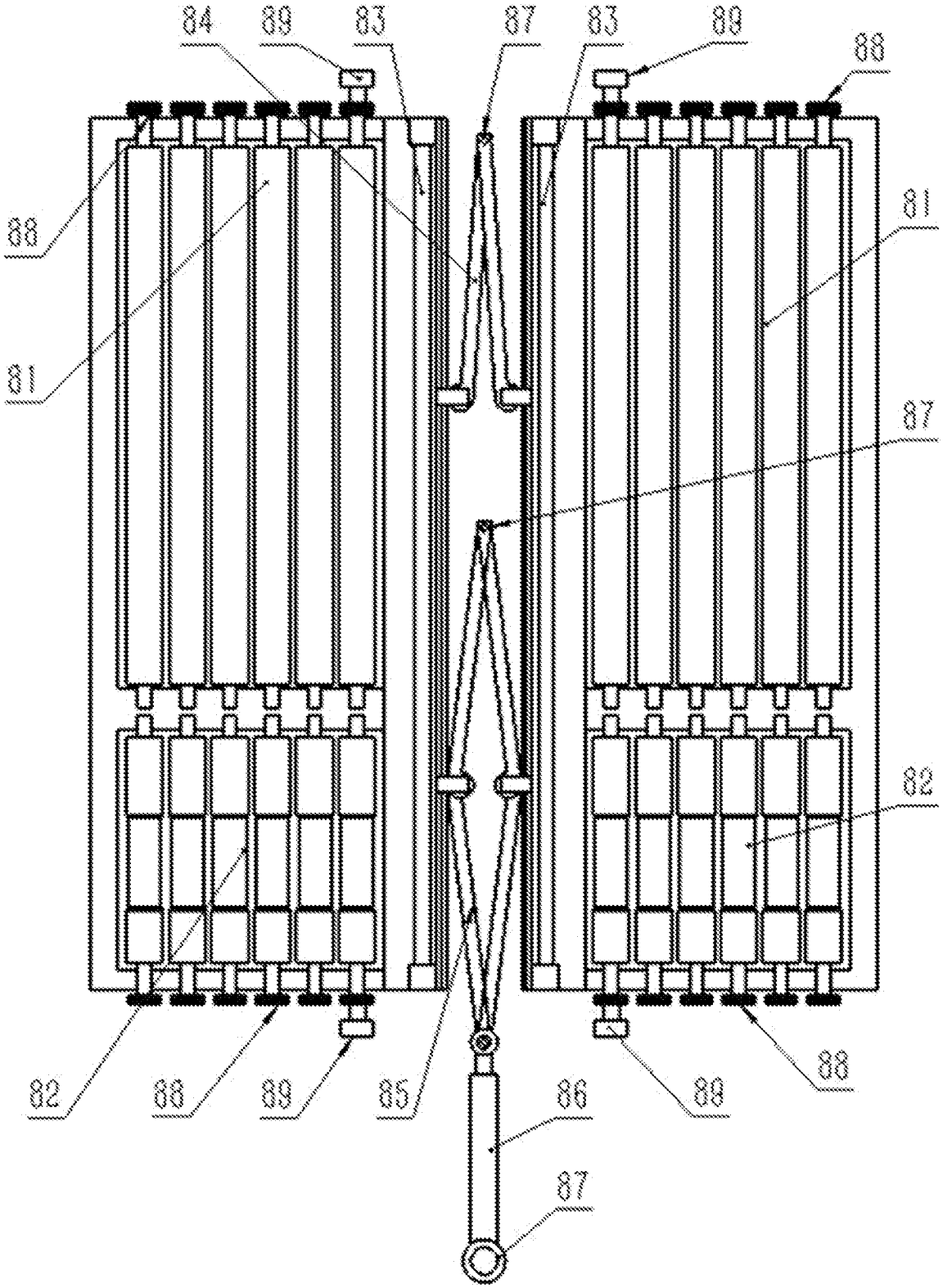
FIG. 12 is a schematic structural diagram of a vehicle body adjustment device.
Figure 13:
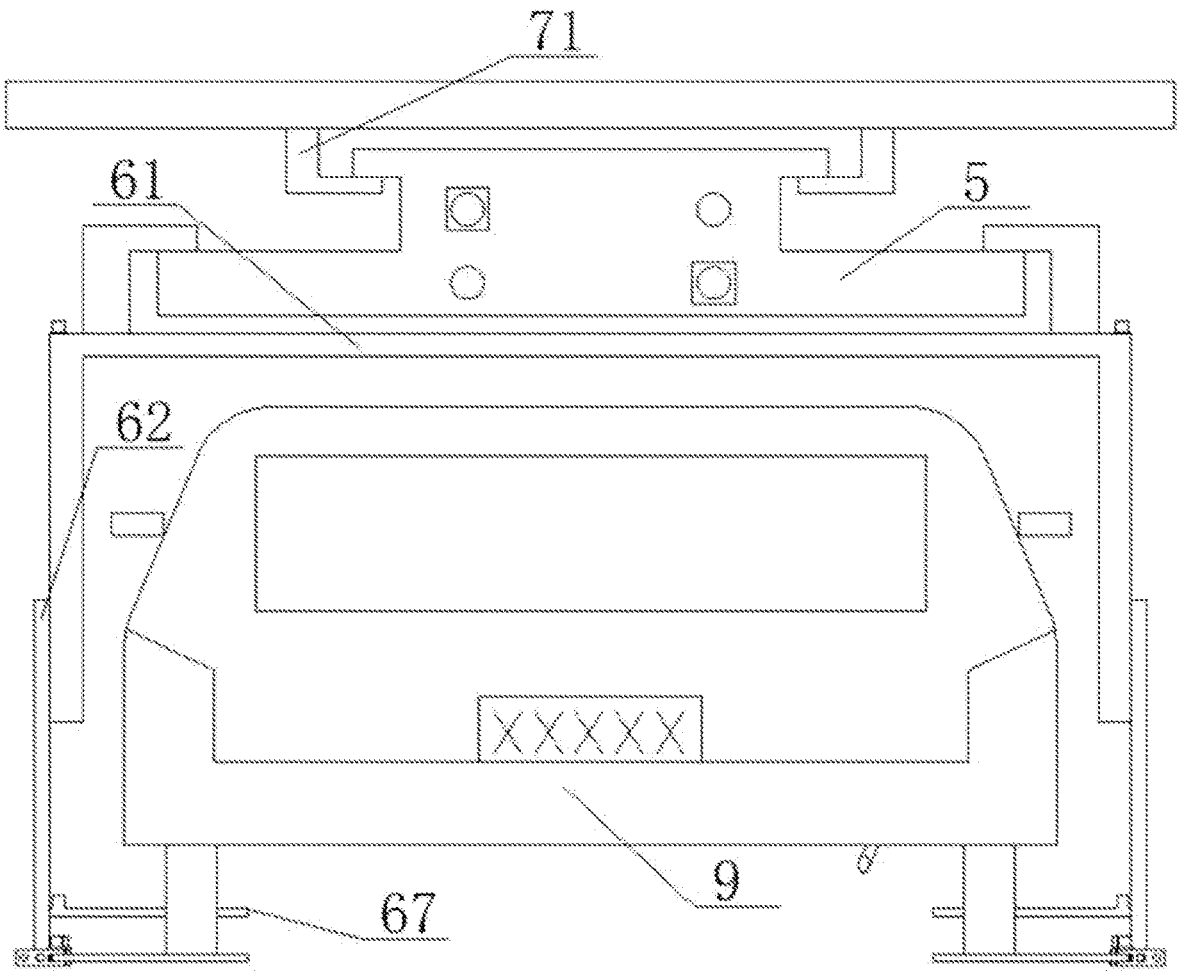
FIG. 13 is a schematic structural diagram of a top of each layer in an annular parking space.

Specific Operation Mode:

As shown in FIG. 7, it is an initial position of the clamping mechanism 6, where the clamping mechanism 6 is located directly below a center of second guide rail 5, a direction of the second guide rail 5 is perpendicular to first guide rail 4, the second guide rail 5 is centered on a side of the first guide rail 4 close to the elevator guide rail seat 3, an initial state of clamping mechanism 6 is that the lifting slider 62 is at the highest position of the supporting frame 61, all of the roller stations are in a closed state, four safety protection rods 67 are respectively attached to the lifting sliders 62, when a vehicle 9 drives into the parking space at the entrance and exit, the vehicle 9 drives onto the adjustment device 8, and when front wheels of the vehicle 9 enter an adjustment concave wheel group 82, it is indicated that the vehicle is basically in place due to a height drop, and then the second bidirectional hydraulic cylinder 86 is driven to make the two bottom plates 88 to move to both side, thereby driving the two long push rods to move to both sides, so that the left and right wheels of the vehicle 9 fit the two long push rods 83, respectively, a center of the vehicle body matches a center of the parking space, and the vehicle body is aligned.

When parking or picking up the vehicle, a motion status of the clamping mechanism 6 is: the motor is driven to work to make the elevator guide rail seat to a specified height, the a first bidirectional hydraulic cylinder or the horizontal motor is driven to rotate the elevator guide rail group, the first guide rail can be adjusted to a designated parking space direction, corresponding to the vehicle whose body has been adjusted or the vehicle to be taken away, the second guide rail slides along the first guide rail to turn, at the same time, the clamping mechanism is driven to move in an opposite direction to the second guide rail, and the clamping mechanism is kept below the first guide rail as much as possible, when the second guide rail enters the hanging auxiliary slideway, the clamping mechanism moves in a direction of the hanging auxiliary slideway, when a sensor of the front roller station of the clamping mechanism 6 detects front wheels of the vehicle, the front second roller 66 is turned to a 90 degree position, the rear first roller 63 is turned to the 90 degree position, when the clamping mechanism 6 continues to move until the front second roller 66 comes into contact with the front wheels of the vehicle, the front first roller 65 turns to the 90 degree position, and the supporting frame 61 stops moving; at this time, the rear first roller 63 continues to move under a drive of the sixth motor until the first roller 63 comes into contact with the rear wheels of the vehicle and stops; at this time, the rear second roller 64 is turned to the 90 degree position, so that each roller is finely adjusted to be in close contact with the corresponding wheels, and the four safety protection rods 67 are respectively turned to the 90 degree position; The lifting slider 62 is driven to rise to lift the vehicle 9 up, the supporting frame 61 is driven to move reversely and suspend below the hanging auxiliary rail 71, when the second guide rail 5 moves back to a certain position, the supporting frame 61 continues to move to restore the clamping mechanism 6 to the initial position, then the elevator guide rail seat 3 is driven to a designated parking space floor, the second guide rail 5, the supporting frame 61 and the lifting slider 62 are driven, the first bidirectional hydraulic cylinder 31 or the horizontal motor 11 is driven to rotate the elevator guide rail group 2, so that the first guide rail 4 can be adjusted to a designated parking space direction, and the vehicle body can be placed in the designated parking space or the parking space at the entrance and exit.

Figure 14:
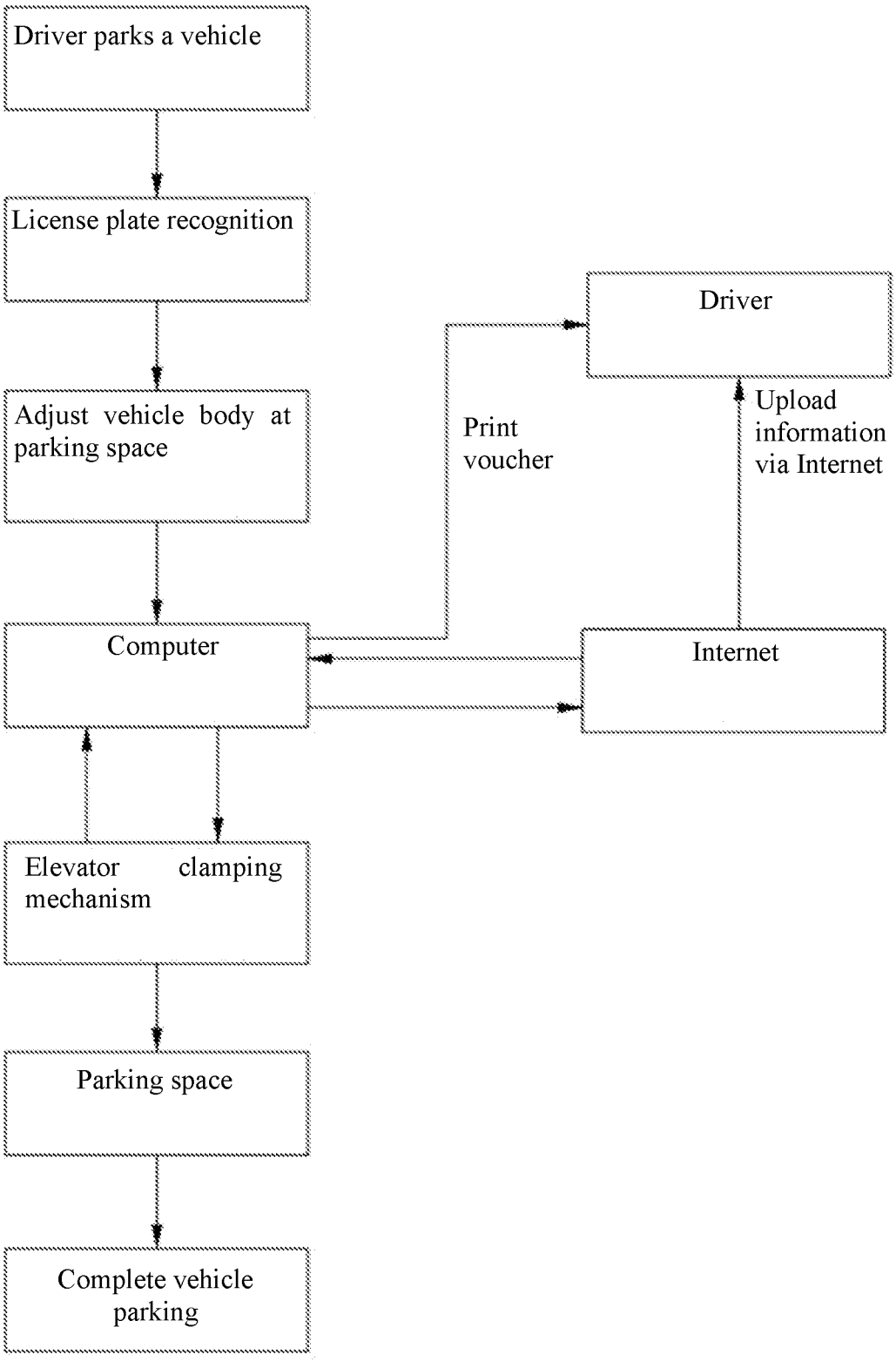
FIG. 14 is a flow chart of vehicle parking in the present invention.

As shown in FIG. 14, when parking the vehicle, a driver drives the vehicle 9 onto the vehicle body adjustment device 8, then the driver gets off, a computer recognizes the number plate of the vehicle 9, the driver can print the voucher, or the computer uploads the information to the driver's mobile phone through the Internet, the vehicle body adjustment device 8 adjusts the vehicle body, and the clamping mechanism 6 puts the vehicle body in the designated parking space to complete the parking.

Figure 15:
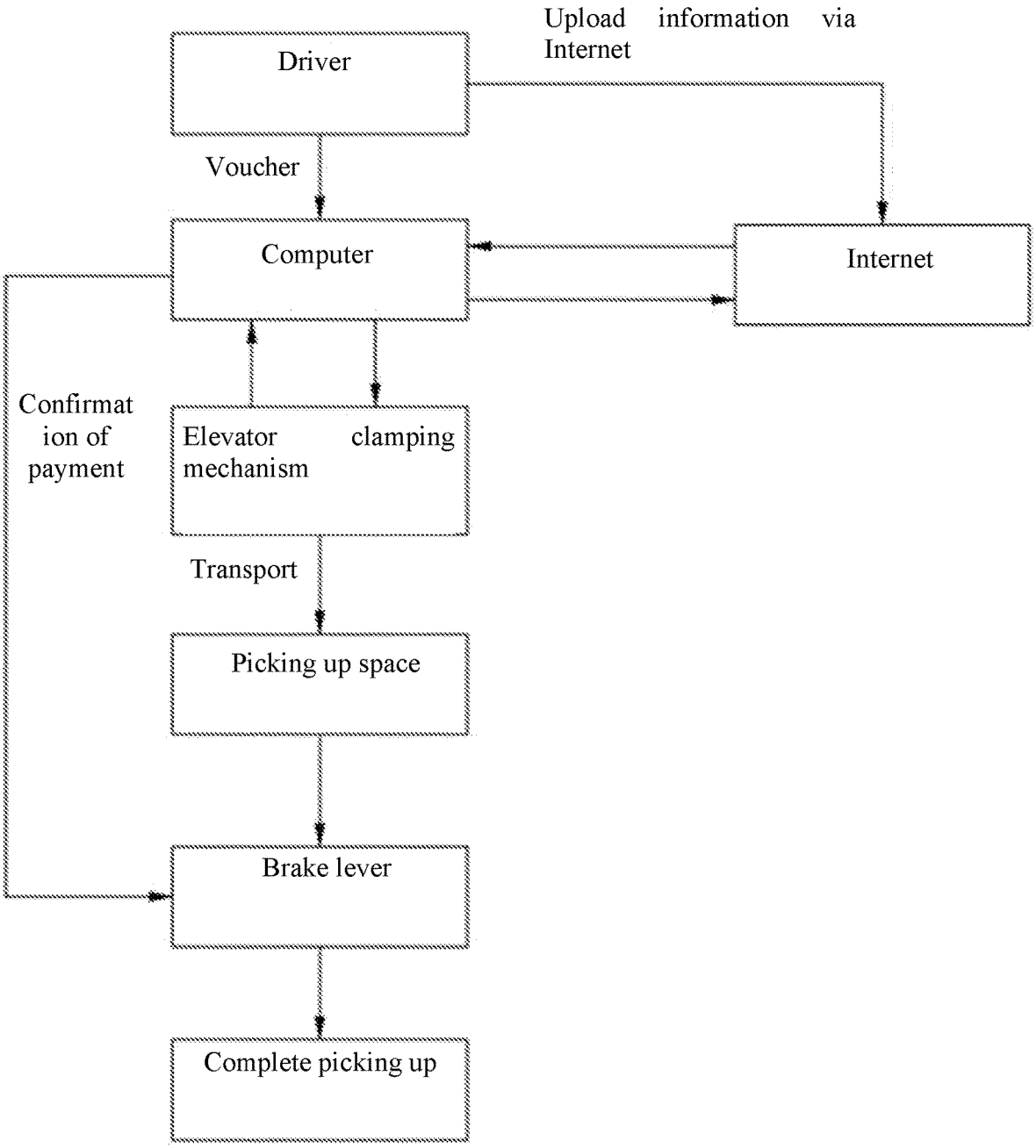
FIG. 15 is a flow chart of vehicle picking up of the present invention.

As shown in FIG. 15, when picking up the vehicle, the driver uploads the vehicle picking up information to the computer through the voucher or the Internet, the clamping mechanism 6 puts the vehicle 9 in the parking space at the entrance and exit where the drive is, and the computer confirms that the driver has paid the parking fee, and raises the brake lever to complete picking up the vehicle.

What is claimed is:

1. A multi-elevator vertically-lifting three-dimensional parking garage comprises: a base, an elevator guide rail group, elevator guide rail seats, first guide rails, second guide rails, clamping mechanisms, annular parking spaces and a vehicle body adjustment device; and the elevator guide rail group is disposed on the base, the base is in a shafting connection with the elevator guide rail group, the elevator guide rail seats configured for sliding up and down are disposed on the elevator guide rail group, the elevator guide rail seats are hingedly connected to the first guide rails, the first guide rails are hingedly connected to the second guide rails in a sliding manner, the second guide rails are connected to the clamping mechanisms in a sliding manner, the annular parking spaces are disposed on a periphery of the elevator guide rail group in a surrounding manner, an upper end of the elevator guide rail group is in the shafting connection with a top of the annular parking spaces, and each parking space at an access floor of the annular parking spaces is provided with the vehicle body adjustment device.

2. The multi-elevator vertically-lifting three-dimensional parking garage according to claim 1, wherein a lower end of the elevator guide rail group is provided with a turbine disk, an upper end of the turbine disk is provided with a disk, a lower end of the turbine disk is a turbine disk convex shaft, an upper end of the disk is a disk convex shaft, three rails are fixedly connected between the turbine disk and the disk, an upper portion of each of the three rails is provided with a bypass wheel a first sprocket wheel is disposed below the bypass wheel, a lower portion of each of the three rails is provided with a second sprocket wheel, the first sprocket wheel is connected with a motor, an inside surface of each of the three rails is provided with a counterweight, the counterweight slides up and down on the inside surface of each of the three rails, an outside surface of each of the three rails is provided with the elevator guide rail seat, and the elevator guide rail seat slides up and down on the outside surface of each of the three rails, the counterweight is connected to the elevator guide rail seat through a traction rope bypassing the bypass wheel, and two ends of a first chain bypass the first sprocket wheel and the second sprocket wheel to be connected to the elevator guide rail seat.

3. The multi-elevator vertically-lifting three-dimensional parking garage according to claim 1, wherein a first bearing is disposed at a center of the base, the base is provided with a horizontal motor connected with a worm, a turbine disk convex shaft is connected with the first bearing, and a turbine disk is connected with the worm.

4. The multi-elevator vertically-lifting three-dimensional parking garage according to claim 1, wherein the elevator guide rail seat is provided with a first bidirectional hydraulic cylinder on a side of the elevator guide rail seat, and the first bidirectional hydraulic cylinder is hingedly connected to the elevator guide rail seat and the first guide rail; and a first screw is disposed in the first guide rail, a first motor is disposed at one end away from the elevator guide rail seat, an output shaft of the first motor is connected with the first screw in the first guide rail through a first coupling, a first slider is disposed on the first guide rail, and the first slider is connected with the first screw through first balls.

5. The multi-elevator vertically-lifting three-dimensional parking garage according to claim 4, wherein the first slider is provided with a second pressure bearing, the second pressure bearing is provided with a rotation shaft, an upper end of the rotation shaft is connected with a third sprocket wheel, the third sprocket wheel is axially fixed with the rotation shaft through a nut on the rotation shaft, the third sprocket wheel is connected with a motor and third sprocket wheel combination, the motor and third sprocket wheel combination is fixedly installed on the first slider, and a lower end of the rotation shaft is fixedly connected with a second slider; and the second slider slides in the second guide rail, a second motor is disposed at a rear position of the second guide rail, an output shaft of the second motor is connected with a second screw in the second guide rail through a second coupling, and the second screw is connected with the second slider through second balls.

6. The multi-elevator vertically-lifting three-dimensional parking garage according to claim 1, wherein the second guide rail is I-shaped and composed of upper and lower rails, and the lower rails are wider than the upper rails; the clamping mechanism is disposed below the second guide rail, and the clamping mechanism is configured to slide in second guide rail; the clamping mechanism comprises a supporting frame, a lifting slider, a front roller station and a rear roller station; fourth screws are respectively disposed at two sides of the supporting frame, and a fourth motor is connected with the fourth screws; lifting sliders are symmetrically disposed on the two sides of the supporting frame, the lifting sliders are connected with the fourth screws through fourth balls, the supporting frame is connected with a horizontal third screw through third balls, the horizontal third screw is disposed on the second guide rail, and the third screw is connected with a third motor through the coupling; and two ends of each of the lifting sliders are respectively provided with the front roller station and the rear roller station.

7. The multi-elevator vertically-lifting three-dimensional parking garage according to claim 6, wherein the front roller station consists of a front first roller and a front second roller, and the front first roller is fixedly connected with the lifting slider; the front second roller is connected with a fifth screw, the fifth screw is connected with a fifth motor fixed on the front first roller, and the front second roller is connected with the front first roller in a sliding manner; the rear roller station consists of a rear first roller and a rear second roller, the front first roller is connected with the front second roller in a sliding manner, the rear second roller is connected with a sixth screw, the sixth screw is connected with a sixth motor fixed on the rear first roller, the rear first roller is connected with a seventh screw, the seventh screw is connected with a seventh motor fixed on the lifting slider, the rear first roller is connected with the lifting slider in a sliding manner, the front first roller, the front second roller, the first roller station and the rear second roller are respectively connected with a motor; and two ends of lower ends of opposite inner sides of two lifting sliders are respectively provided with safety protection rods, the safety protection rods are in the shafting connection with the two lifting sliders, the safety protection rods are connected with a motor, a level of each of the safety protection rods is higher than levels of the front roller station and the rear roller station.

8. The multi-elevator vertically-lifting three-dimensional parking garage according to claim 1, wherein the annular parking space is divided into the access floor with entrances and exits and basic floors with only parking spaces, the parking spaces on each of the basic floors are aligned up and down, a top of each layer of the annular parking space is provided with a hanging auxiliary slideway, the hanging auxiliary slideway is mated with the second guide rail, an upper end of the annular parking space is provided with a cross beam, the cross beam is fixedly connected with the annular parking space, a shaft hole is disposed in a center of the cross beam, and a disk convex shaft is connected in the shaft hole, and each parking space on the access floor of the annular parking space is provided with the vehicle body adjustment device.

9. The multi-elevator vertically-lifting three-dimensional parking garage according to claim 1, wherein the vehicle body adjustment device consists of a roller part and an adjustment mechanism, wherein the roller part consists of two pairs of roller groups and two pairs of concave wheel groups longitudinally disposed on a bottom plate; the adjustment mechanism consists of two long push rods, an articulated link, a parallel articulated four-link, a second bidirectional hydraulic cylinder, a stationary shaft, a third sprocket wheel and an electromagnetic clutch; the articulated link and the parallel articulated four-link are respectively hingedly connected to the two long push rods, a plane position of each of the two long push rods is higher than a height of a plane where the two pairs of roller groups and the two pairs of concave wheel groups are located, each roller of the two pairs of roller groups and the two pairs of concave wheel groups is connected with the third sprocket wheel, the third sprocket wheels on the two pairs of roller groups and the two pairs of concave wheel groups is connected by a second chain and connected to the electromagnetic clutch, the articulated link is fixed on the bottom plate through the stationary shaft, a first end of the parallel articulated four-link is fixed on the bottom plate through the stationary shaft, a second end of the parallel articulated four-link is hinged with a first end of the second bidirectional hydraulic cylinder, and a second end of the second bidirectional hydraulic cylinder is fixed on the bottom plate by the stationary shaft.

10. The multi-elevator vertically-lifting three-dimensional parking garage according to claim 1, wherein all moving parts are run under a control of a parking garage central computer; the parking garage central computer comprises: a vehicle information collection system, a vehicle measurement system, a parking space allocation system, a motion management system, a monitoring system and a parking fee collection system.

* * * * *